US007761292B2

(12) United States Patent
Ferencz et al.

(10) Patent No.: US 7,761,292 B2
(45) Date of Patent: Jul. 20, 2010

(54) METHOD AND APPARATUS FOR DISTURBING THE RADIATED VOICE SIGNAL BY ATTENUATION AND MASKING

(75) Inventors: Attiia Ferencz, Suwon-si (KR); Jun-il Sohn, Yongin-si (KR); Kwon-ju Yi, Yongin-si (KR); Yong-beom Lee, Seoul (KR); Sang-ryong Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 630 days.

(21) Appl. No.: 11/528,316

(22) Filed: Sep. 28, 2006

(65) Prior Publication Data

US 2007/0083361 A1 Apr. 12, 2007

(30) Foreign Application Priority Data

Oct. 12, 2005 (KR) ..... 10-2005-0096213

(51) Int. Cl.
*G10L 21/02* (2006.01)

(52) U.S. Cl. ..... 704/226; 704/200; 704/200.1

(58) Field of Classification Search ..... 704/200, 704/203, 205, 207, 255, 256, 227, 228, 226, 704/225, 200.1, 278, 224; 379/390.01
See application file for complete search history.

(56) References Cited

U.S. PATENT DOCUMENTS 6,952,471 B1 * 10/2005 Cannon et al. ..... 379/390.01
2003/0048910 A1 3/2003 Roy et al.
2004/0125922 A1 7/2004 Specht
2004/0192243 A1 9/2004 Siegel

FOREIGN PATENT DOCUMENTS

| | | |
|---|---|---|
| JP | 10-23128 | 1/1998 |
| JP | 10-247968 | 9/1998 |
| JP | 2004-157238 | 6/2004 |
| KR | 10-2000-0038271 | 7/2000 |
| KR | 2003-0022716 | 3/2003 |
| KR | 10-2006-0061451 | 6/2006 |

OTHER PUBLICATIONS

Notice of Allowance issued in corresponding Korean Patent Application No. 10-2005-0096213, on May 31, 2007.

* cited by examiner

*Primary Examiner*—Huyen X. Vo
(74) *Attorney, Agent, or Firm*—Staas & Halsey LLP

(57) ABSTRACT

A method and apparatus to disturb a voice signal by attenuating and masking the voice signal are provided. The method includes; receiving a voice signal from a wired or wireless network; obtaining a masked voice signal by dividing the received voice signal into a plurality of segments of the same size; outputting the received voice signal and receiving a feedback signal of the output voice signal; obtaining an attenuated voice signal by performing a first sound attenuation operation on the feedback signal; and combining the attenuated voice signal and the masked voice signal and outputting the result of the combination as disturbing sound.

11 Claims, 7 Drawing Sheets

METHOD AND APPARATUS FOR DISTURBING THE RADIATED VOICE SIGNAL BY ATTENUATION AND MASKING

CROSS-REFERENCE TO RELATED APPLICATION

This application claims priority from Korean Patent Application No. 10-2005-0096213 filed on Oct. 12, 2005, in the Korean Intellectual Property Office, the disclosure of which is incorporated herein by reference in its entirety.

BACKGROUND OF THE INVENTION

1. Field of the Invention

The present invention relates to a method and apparatus to disturb an unwanted radiated voice signals from communication device, and more particularly, to a method and/or apparatus to generate and output disturbing sound so that a phone speech signal that is supposed to be only heard by parties who are currently engaging in a phone conversation (so called active listener) cannot be recognized by third parties (so called passive listener).

2. Description of the Related Art

The privacy of phone conversations conducted using mobile phones or landline phones in offices sometimes may not be fully guaranteed depending on the situation of users who are conversing on the phone. Users must walk out of earshot of the surrounding parties in order to prevent their phone conversations from being heard to the third parties. Therefore, techniques of preventing phone speech from being heard to the third parties are necessary. Sometimes, users have to have a phone conversation even when the users cannot walk away from the third parties such as when they are in a vehicle with the third parties or the users are answering the phone in the middle of a conference. In this case, the third parties can listen to the phone conversation that may contain personal or confidential information.

U.S. Patent Publication Application No. 2003-0048910 discloses a method of masking sounds within enclosed spaces. According to this sound masking method, a sound masking system is attached onto the ceiling of an enclosed space, and masks sounds generated within the enclosed space. This sound masking method simply modulates voice by masking sounds generated within an enclosed space. Thus, this sound masking method is not suitable for masking sounds in a mobile environment.

In addition, Korean Patent Laid-Open Gazette No. 2003-22716 discloses a sound masking system which can be installed near a speaker of a telephone receiver. This sound masking system requires a user to place a telephone receive in firm contact with his/her ear in order to prevent an incoming voice signal from being heard to third parties. However, due to the properties of sound waves, it is hard to completely prevent an incoming voice signal from being heard externally no matter how hard the user tries to have a private or confidential phone conversation. Thus, there is always a probability that the content of a phone conversation can be recognized by the third parties.

Given all this, it is necessary to develop methods and systems which can guarantee the privacy of phone conversations without requiring a user to walk away from the surrounding parties and prevent phone conversations, particularly, those containing confidential information from being heard by other parties. In other words, methods and systems capable of preventing the content of a phone conversation from being heard by other parties while not interfering with those who participate in the phone conversation are required.

SUMMARY OF THE INVENTION

Additional aspects and/or advantages of the invention will be set forth in part in the description which follows and, in part, will be apparent from the description, or may be learned by practice of the invention.

The present invention provides a method and apparatus to protect the privacy of the content of a phone conversation.

The present invention also provides a method and apparatus to generate and outputting disturbing sound in which disturbing sound is generated by attenuating and masking a phone speech signal that can be heard by third parties and the disturbing sound is output.

According to an aspect of the present invention, there is provided a method of disturbing a voice signal by attenuating and masking the voice signal. The method includes receiving a voice signal from a wired or wireless network; obtaining a masked voice signal by dividing the received voice signal into a plurality of segments of the same size; outputting the received voice signal and receiving a feedback signal of the output voice signal; obtaining an attenuated voice signal by performing a first sound attenuation operation on the feedback signal; and combining the attenuated voice signal and the masked voice signal and outputting the result of the combination as disturbing sound.

According to another aspect of the present invention, there is provided an apparatus to disturb a voice signal by attenuating and masking the voice signal. The apparatus includes a masking sound generation unit to receive a voice signal from a wired or wireless network, and obtains a masked voice signal by dividing the received voice signal into a plurality of segments of the same size; a sound output unit to output the received voice signal; a sensing microphone to receive a feedback signal of the voice signal output by the sound output unit; a first attenuation filter unit to attenuate the feedback signal received by the sensing microphone; and a disturbing sound output unit to combine the attenuated feedback signal and the masked voice signal.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
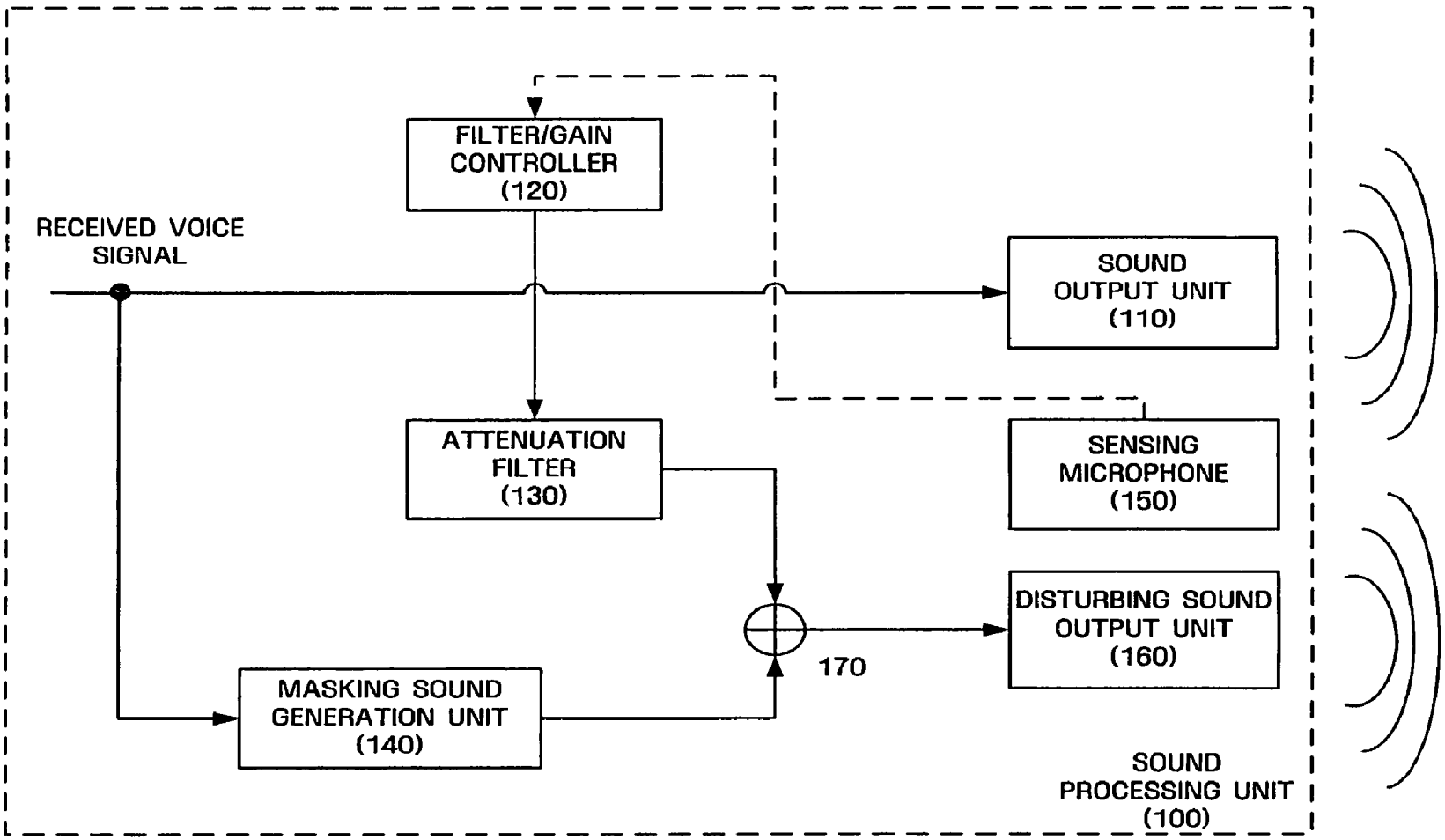
FIG. 1 is a block diagram of a sound processing unit according to an embodiment of the present invention.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals in the drawings denote like elements, and thus their description will be omitted.

A plurality of blocks of the accompanying block diagrams and a plurality of operational steps of the accompanying flowcharts may be executed by computer program instructions. The computer program instructions may be uploaded to general purpose computers, special purpose computers, or processors of other programmable data processing devices. When being executed by general purpose computers, special purpose computers, or processors of other programmable data processing devices, the computer program instructions can implement in various ways the functions specified in the accompanying block diagrams or flowcharts.

Also, the computer program instructions can be stored in computer-readable memories which can direct computers or other programmable data processing devices to function in a particular manner. When stored in computer-readable memories, the computer program instructions can produce an article of manufacture including instruction means which implement the functions specified in the accompanying block diagrams and flowcharts. The computer program instructions may also be loaded onto computers or other programmable data processing devices to allow the computers or other programmable data processing devices to realize a series of operational steps and to produce computer-executable processes. Thus, when being executed by computers or other programmable data processing devices, the computer program instructions provide steps for implementing the functions specified in the accompanying block diagrams and flowcharts.

The blocks of the accompanying block diagrams or the operational steps of the accompanying flowcharts may be represented by modules, segments, or portions of code which comprise one or more executable instructions to execute the functions specified in the respective blocks of operational steps of the accompanying block diagrams and flowcharts. The functions specified in the accompanying block diagrams and flowcharts may be executed in a different order from those set forth herein. For example, two adjacent blocks or operational steps in the accompanying block diagrams or flowcharts may be executed at the same time or in a different order from that set forth herein.

In this disclosure, the terms 'unit', 'module', and 'table' refer to a software program or a hardware device (such as a field programmable gate array (FPGA) or an application specific integrated circuit (ASIC)) which performs a predetermined function. However, the present invention is not restricted to this. In particular, modules may be implemented in a storage medium which can be addressed or may be configured to be able to execute one or more processors. Examples of the modules include software components, object-oriented software components, class components, task components, processes, functions, attributes, procedures, sub-routines, program code segments, drivers, firmware, microcode, circuits, data, databases, data architecture, tables, arrays, and variables. The functions provided by components or modules may be integrated with one another so that they can executed by a smaller number of components or modules or may be divided into smaller functions so that they need additional components or modules. Also, components or modules may be realized to drive one ore more CPUs in a device.

FIG. 1 is a block diagram of a sound processing unit 100 according to an embodiment of the present invention. Specifically, FIG. 1 illustrates only a part of a mobile communication device related to a speaker and a microphone. The sound processing unit 100 illustrated in FIG. 1 can be applied to a mobile phone, a landline phone, and a personal digital assistant (PDA) phone. But it is not restricted thereto.

Referring to FIG. 1, a received voice signal is output by a sound output unit 110. The sound output unit 110 allows a user to hear the received voice signal. The voice signal output by the sound output unit 110 is received by a sensing microphone 150. The sensing microphone 150 senses the voice signal output by the sound output unit 110 in order to determine how the voice signal output by the sound output unit 110 will be heard by a third party around the user. The voice signal sensed by the sensing microphone 150 is input to a filter/gain controller 120. Then the filter/gain controller 120 adjusts the gain of the voice signal sensed by the sensing microphone 150 or performs a filtering on the voice signal sensed by the sensing microphone 150. A voice signal output by the filter/gain controller 120 is input to an attenuation filter 130. The attenuation filter 130 performs attenuation filtering on the voice signal output by the filter/gain controller 120, thereby obtaining an attenuated voice signal.

The received voice signal is also input to a masking sound generation unit 140. Then the masking sound generation unit 140 obtains a masked voice signal by performing sound masking on the received voice signal so that formant frequencies can be removed from the received voice signal. As a result of the sound masking performed by the masking sound generation unit 140, all formant information disappears from the received voice signal, and thus, the third party cannot recognize the received voice signal.

The attenuated voice signal obtained by the attenuation filter 130 and the masked voice signal obtained by the masking sound generation unit 140 are transmitted to a disturbing sound output unit 160. A combiner 170 combines the attenuated voice signal and the masked voice signal using and output. The disturbing sound output unit 160 outputs a disturbing sound signal to the third party so that the third party cannot recognize the voice signal output by the sound output unit 110. It is understood that the combiner 170 can be disposed in the disturbing sound output unit 160 as a single unit.

In a mobile phone environment, the location of the third party is not fixed. Therefore, there are limitations in precisely determining how the voice signal output by the sound output unit 110 will be heard by the third party simply based on the voice signal sensed by the sensing microphone 150. Thus, the sensing microphone 150 may be attached onto, for example, the rear surface of a mobile phone, to face a direction where the third party is likely to hear the voice signal. Then the received voice signal is output by the sound output unit 110, and the output voice signal is fed back into the sound processing unit 100 by the sensing microphone 150. The attenuation filter 130 performs sound attenuation on the feed-back voice signal by modifying the properties of sound to be heard by the third party. An attenuated voice signal obtained by the attenuation filter 130 is output via the disturbing sound output unit 160 so that the third party cannot recognize the content of a phone conversation (hereinafter referred to as the current phone conversation) in which the user is currently engaging.

However, the sensing microphone 150 does not sense the voice signal output by the sound output unit 110 by determining the exact location of the third party. Thus, the attenuation filter 130 may not be able to completely disturb the received voice signal solely based on the voice signal sensed by the sensing microphone 150. Thus, according to an embodiment of the present embodiment, the attenuated voice signal obtained by the attenuation filter 130 is output together with the masked voice signal obtained by the masking sound generation unit 140 so that the third party cannot recognize the content of the current phone conversation.

Figure 2:
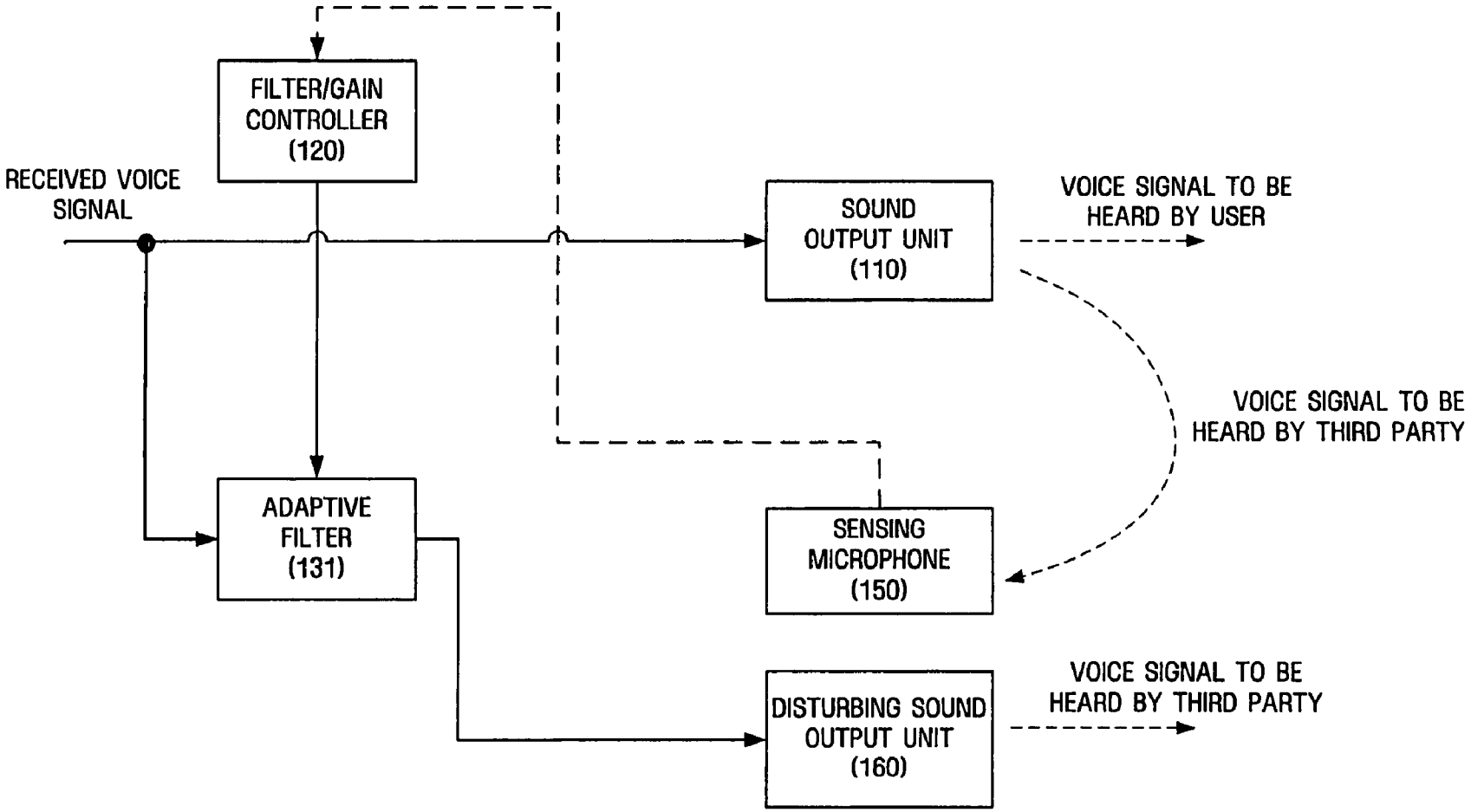
FIG. 2 is a block diagram to explain sound attenuation according to an embodiment of the present invention.

FIG. 2 is a block diagram to explain sound attenuation according to an embodiment of the present invention. Referring to FIG. 2, a received voice signal is transmitted to the user by the sound output unit 110. The received voice signal is also input to the filter/gain controller 120 via the sensing microphone 150, which is on the opposite side of the sound output unit 110. An adaptive filter 131 generates disturbing sound based on the received voice signal and output signal of filter/gain controller 120 the voice signal sensed by the sensing microphone 150.

It can be determined how the voice signal output by the sound output unit 110 will be heard by a third party based on the voice signal sensed by the sensing microphone 150. Since the location of the third party is not fixed, there are limitations in precisely determining how the voice signal output by the sound output unit 110 will be heard by the third party simply based on the voice signal sensed by the sensing microphone 150. Thus, disturbing sound is output to disturb the received voice signal. Then the third party cannot properly recognize the content of the current phone conversation.

According to the present embodiment, a sound attenuation method is used to reduce the energy of the voice signal sensed by the sensing microphone 150. By using the sound attenuation method, a signal whose phase is opposite to the phase of the voice signal sensed by the sensing microphone 150 generate so that the generated signal can attenuate or completely cancel out the voice signal sensed by the sensing microphone 150.

An attenuated voice signal is output via the disturbing sound output unit 160. Then, the third party can only hear disturbing sound and thus, unlike the user, cannot recognize the received voice signal. According to an aspect of the present embodiment, the adaptive filter 131 is used to perform sound attenuation.

Figure 3:
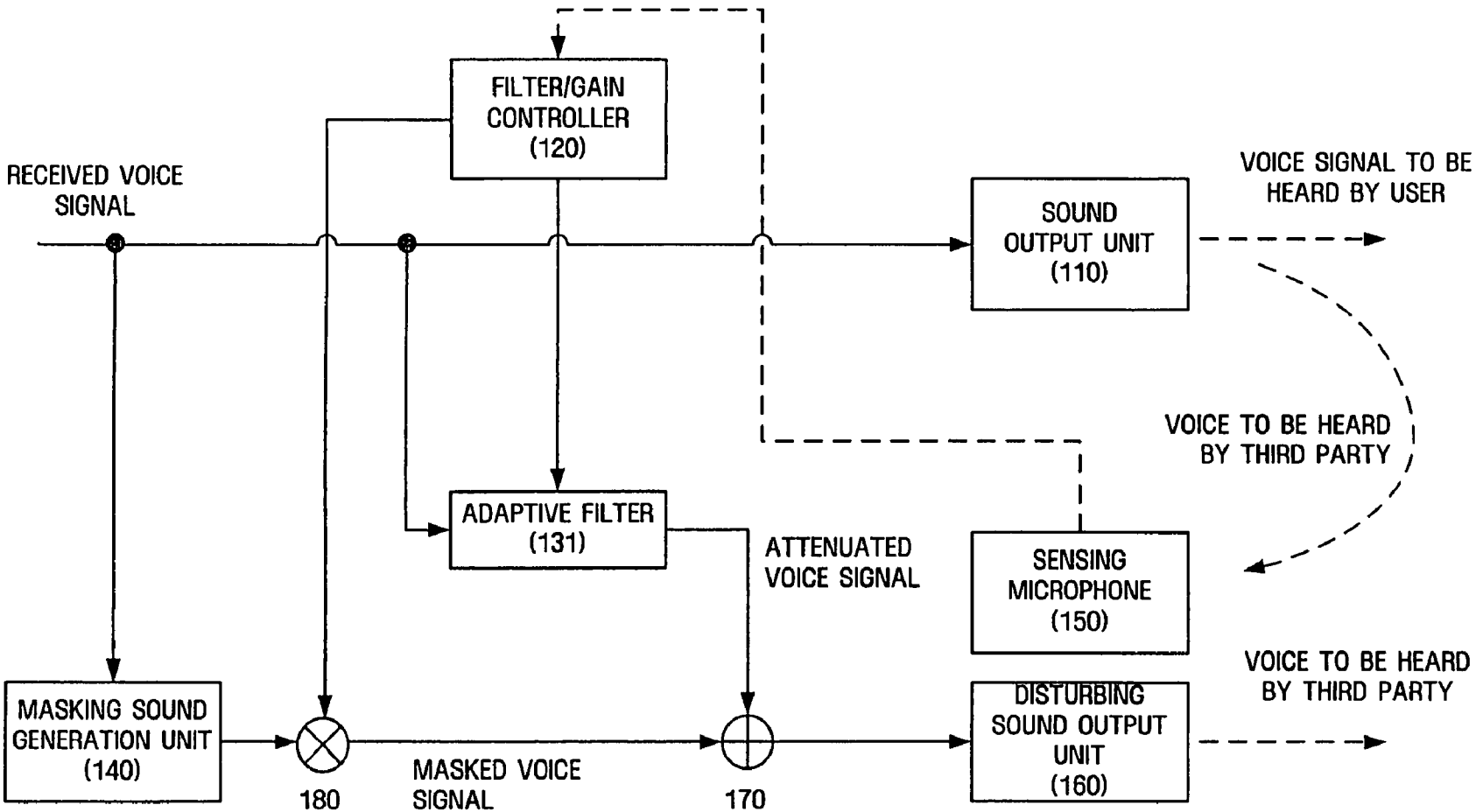
FIG. 3 is a block diagram to explain sound masking according to an embodiment of the present invention.

FIG. 3 is a block diagram to explain sound masking according to an embodiment of the present invention. When there are third parties around a user and the locations of the third parties are not fixed, the third parties can hear at least part of the received voice signal. Thus, a sound masking method is used together with the sound attenuation method.

The masking sound generation unit 140 performs sound masking on a received voice signal, thereby obtaining a masked voice signal. Also, the masking sound generation unit 140 performs masking a received voice signal. A gain controller 180 controls a gain of the masked voice signal which is input from the masking sound generation unit 140 based on a feedback signal of the received voice signal, which is output via the filter/gain controller 120. An adaptive filter 131 generates disturbing sound based on the received voice signal and the output of filter/gain controller 120. In order to enhance the effect of sound disturbance, a combiner 170 combines the masked voice signal and an attenuated voice signal obtained by the adaptive filter 131, and the result of the combination is output via the disturbing sound output unit 160 as disturbing sound.

The disturbing sound output by the disturbing sound output unit 160 can be heard not only by the third party but also by the user, thus interfering with the user's recognition of the received voice signal. Therefore, the disturbing sound must be attenuated for the user, and a method of attenuating the disturbing sound will hereinafter be described in detail with reference to FIG. 4.

Figure 4:
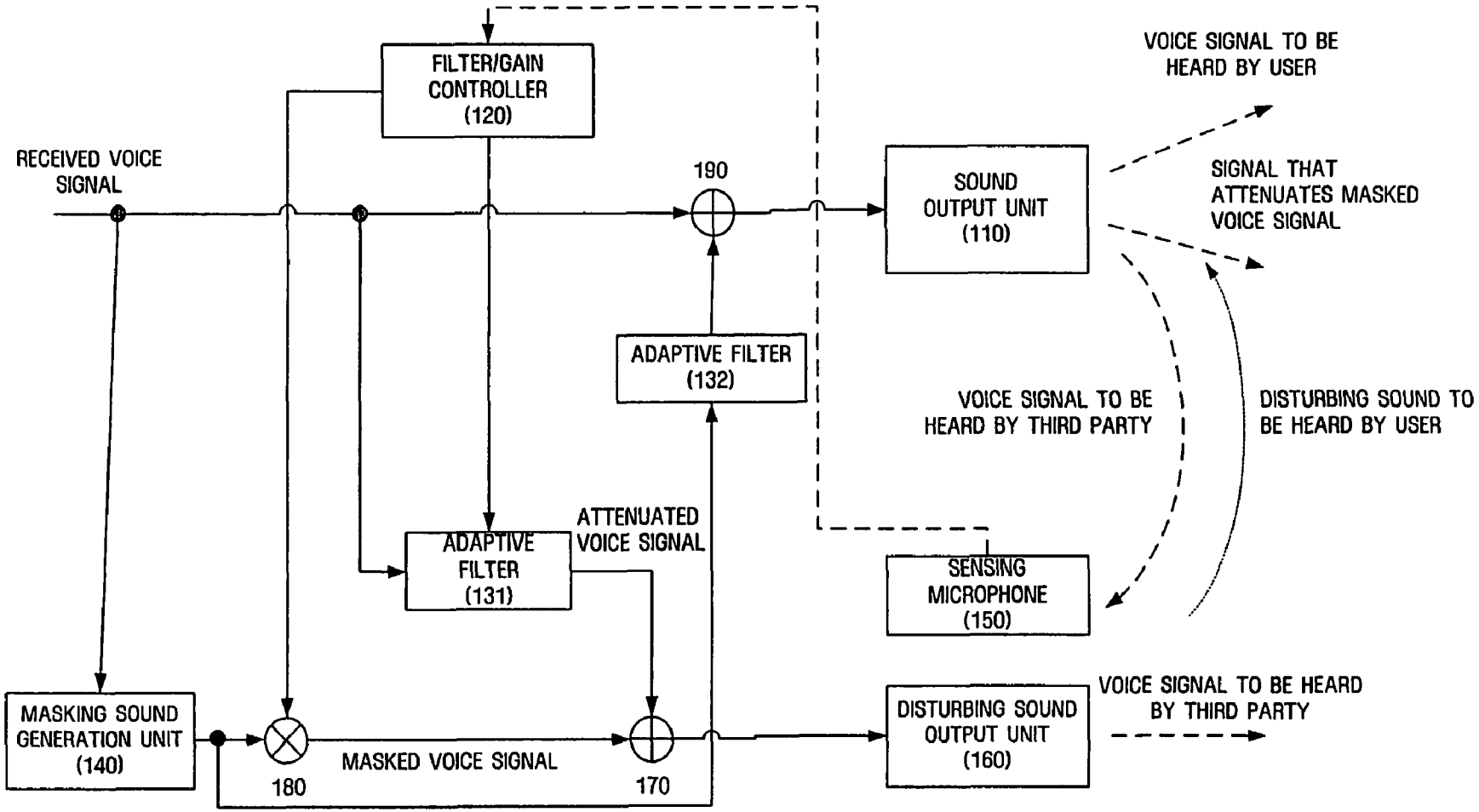
FIG. 4 is a block diagram to explain the output of an attenuated disturbing sound signal by a sound output unit for a user, according to an embodiment of the present invention.

FIG. 4 is a block diagram to explain the outputting of an attenuated disturbing sound signal by the sound output unit 110 for a user according to an embodiment of the present invention. Referring to FIG. 4, the disturbing sound output unit 160 can be attached onto a mobile phone, and thus, disturbing sound output via the disturbing sound output unit 160 can be heard by the user. Therefore, the disturbing sound heard by the user can be masked using the same system used by the disturbing sound output unit 160 to generate the disturbing sound.

A masked voice signal is input to the adaptive filter 132. The adaptive filter 132 generates an attenuation signal that can attenuate the masked voice signal. A combiner 190 combines the attenuated voice signal and the received voice signal and outputs the generated attenuation signal via the sound output unit 110. The phase of the generated attenuation signal may be opposite to the phase of the masked voice signal.

Figure 5:
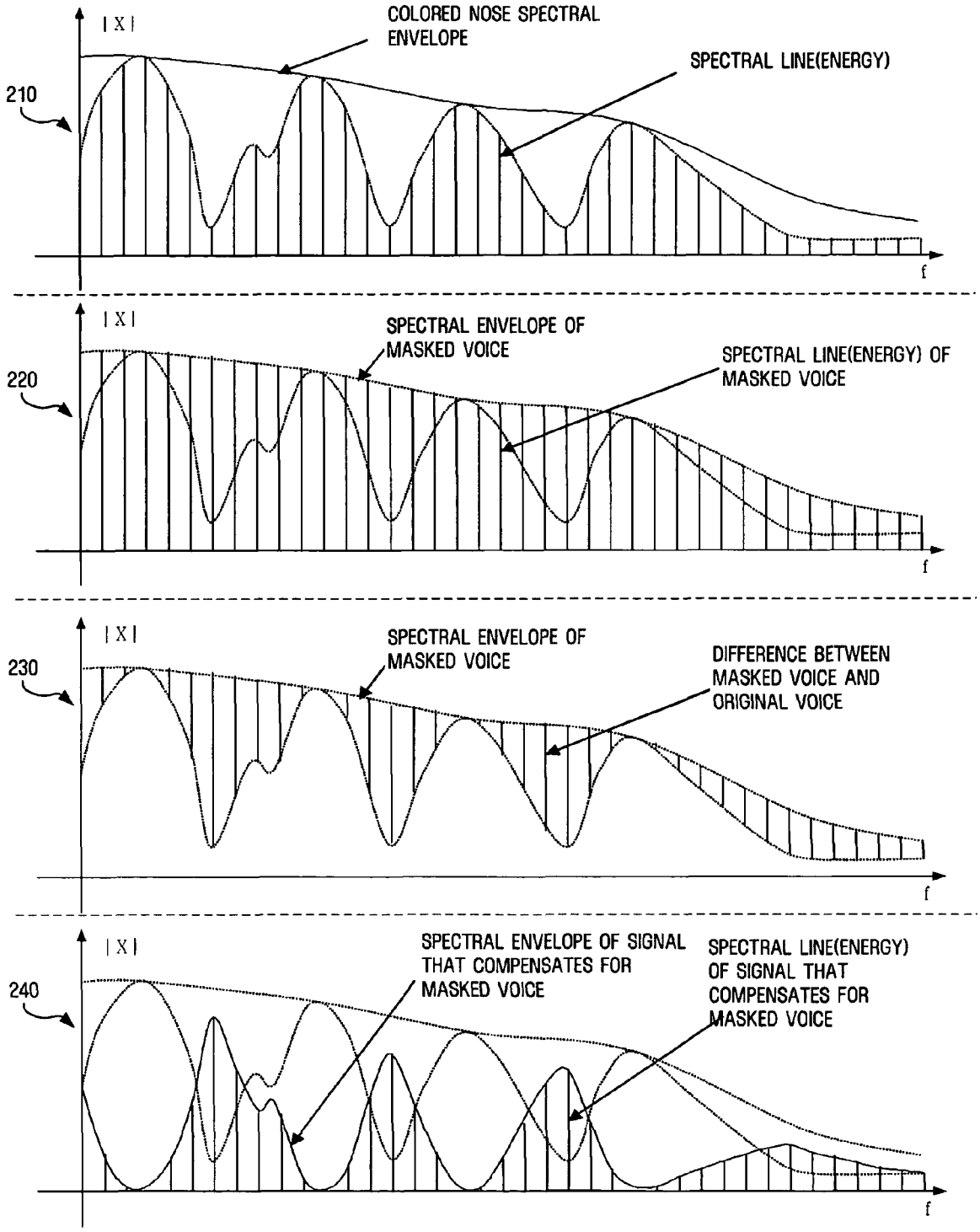
FIG. 5 is a diagram to explain changes made to a received voice signal when performing sound masking on the received voice signal according to an embodiment of the present invention.

FIG. 5 is a diagram to explain changes made to a received voice signal when performing sound masking on the received voice signal according to an embodiment of the present invention. Referring to FIG. 5, reference numeral 210 represents a received voice signal. A plurality of spectral lines of the received voice signal 210 include formant information. Formants, which are distinctive and meaningful components of human speech, are one of the most important properties of frames from a psycholinguistic point of view. Sound is a phenomenon of the vibration of particles in the air whereby energy is transmitted to the human auditory organs (e.g., the tympanic membrane, the cochlear duct, and neural cells) through a medium such as the air. Sound generated by the human vocal organs (i.e., the lungs, the vocal cord, the oral cavity, and the tongue) is comprised of a variety of overlapping frequencies. In general, there are three to five peaks among the frequencies of a plurality of components of a human voice resulting from the vibration and resonance of the vocal cord when the human voice is produced, and these frequency peaks are referred to as formant frequencies.

Formant frequencies vary from one speech to another and also vary over time. People can recognize and human voices based on the variations in the formant frequencies. Thus, when formant information is removed from human speech, a user may not be able to recognize the human speech.

Formant information of speech is transmitted by a plurality of spectral lines of the speech. Thus, if a spectral envelope, which is a curve passing through the peaks of the spectrum of the received voice signal 210, is masked, a user may not be able to recognize the received voice signal 210.

Reference numeral 220 represents a masked voice signal obtained by masking the spectral envelope of the received voice signal 210. Formant information cannot be extracted from the masked voice signal 220. In order to generate the masked voice signal 220, a predetermined masking signal that can mask the received voice signal 210 must be generated.

Reference numeral 230 illustrates the difference between the masked voice signal 220 and the received voice signal 210. Reference numeral 240 represents a signal that compensates for the difference between the phase of masked voice signal 220 and the phase of the received voice signal 210. The masked voice signal 220 is generated by outputting the signal 240 and the received voice signal 210 together.

Figure 6:
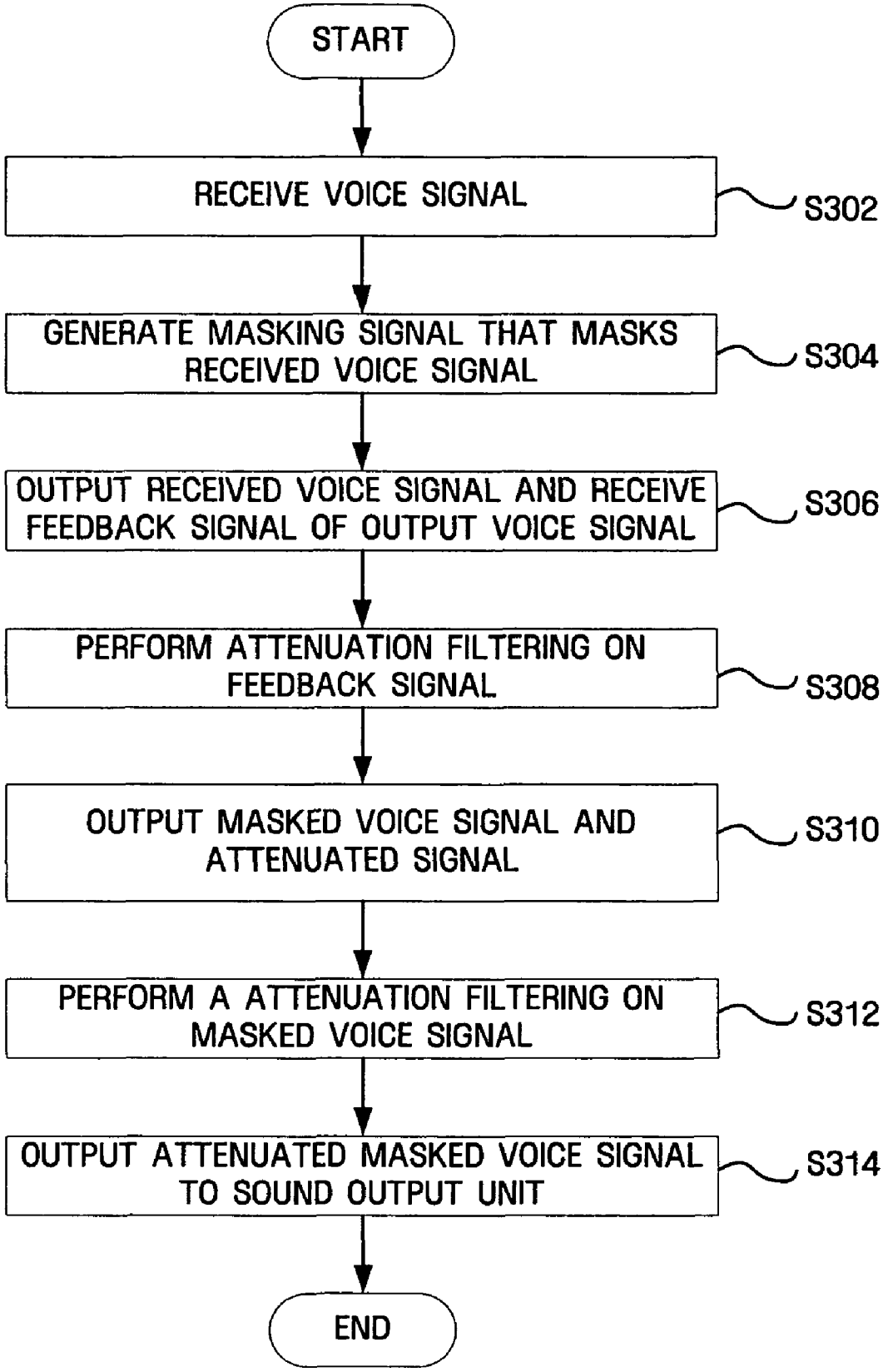
FIG. 6 is a flowchart illustrating a method of outputting disturbing sound to a third party by outputting a masked voice signal and a attenuated voice signal together, according to an embodiment of the present invention.

FIG. 6 is a flowchart illustrating a method of outputting disturbing sound to a third party by outputting a masked voice signal and an attenuated voice signal together, according to an embodiment of the present invention. The method illustrated in FIG. 6 can be performed by devices capable of receiving voice data such as mobile phones, PDA phones, or landline phones. A detailed description of the reception of voice data from a wired or wireless network will be omitted.

Referring to FIG. 6, in operation S302, a voice signal is received from a wired or wireless network. In operation S304, a masking signal that can mask the received voice signal is generated, and the received voice signal is masked using the masking signal. The masking of the received voice signal may be performed by the masking sound generation unit 140 illustrated in FIG. 1, using the sound masking method illustrated in FIG. 5. In operation S306, the received voice signal is output, and a feedback signal of the output voice signal is obtained in order to generate an attenuated voice signal which is to be output together with the masked voice signal.

In operation S308, the feedback signal is transmitted to an attenuation filter via a filter/gain controller, and then the attenuation filter performs attenuation filtering on the feedback signal, thereby obtaining an attenuated voice signal. The attenuation filter may use an adaptive filter to perform attenuation filtering. Here, the feedback signal is a voice signal received by a sensing microphone attached to, for example, a mobile phone.

In operation S310, the attenuated voice signal obtained in operation S308 and the masked voice signal obtained in operation S304 are output to a disturbing sound output unit. Then the disturbing sound output unit outputs the attenuated voice signal and the masked voice signal together so that a third party can only hear them as disturbing sound. Accordingly, the third party cannot recognize the content of a current phone conversation.

In operation S312, in order to prevent the disturbing sound output by the disturbing sound output unit from interfering with the current phone conversation, attenuation filtering is performed on the masked voice signal obtained in operation S304. In operation S314, the result of the attenuation filtering performed in operation S312 is output via a sound output unit to attenuate the disturbing sound output by the disturbing sound output unit. Then the user can hear the attenuated disturbing sound.

Figure 7:
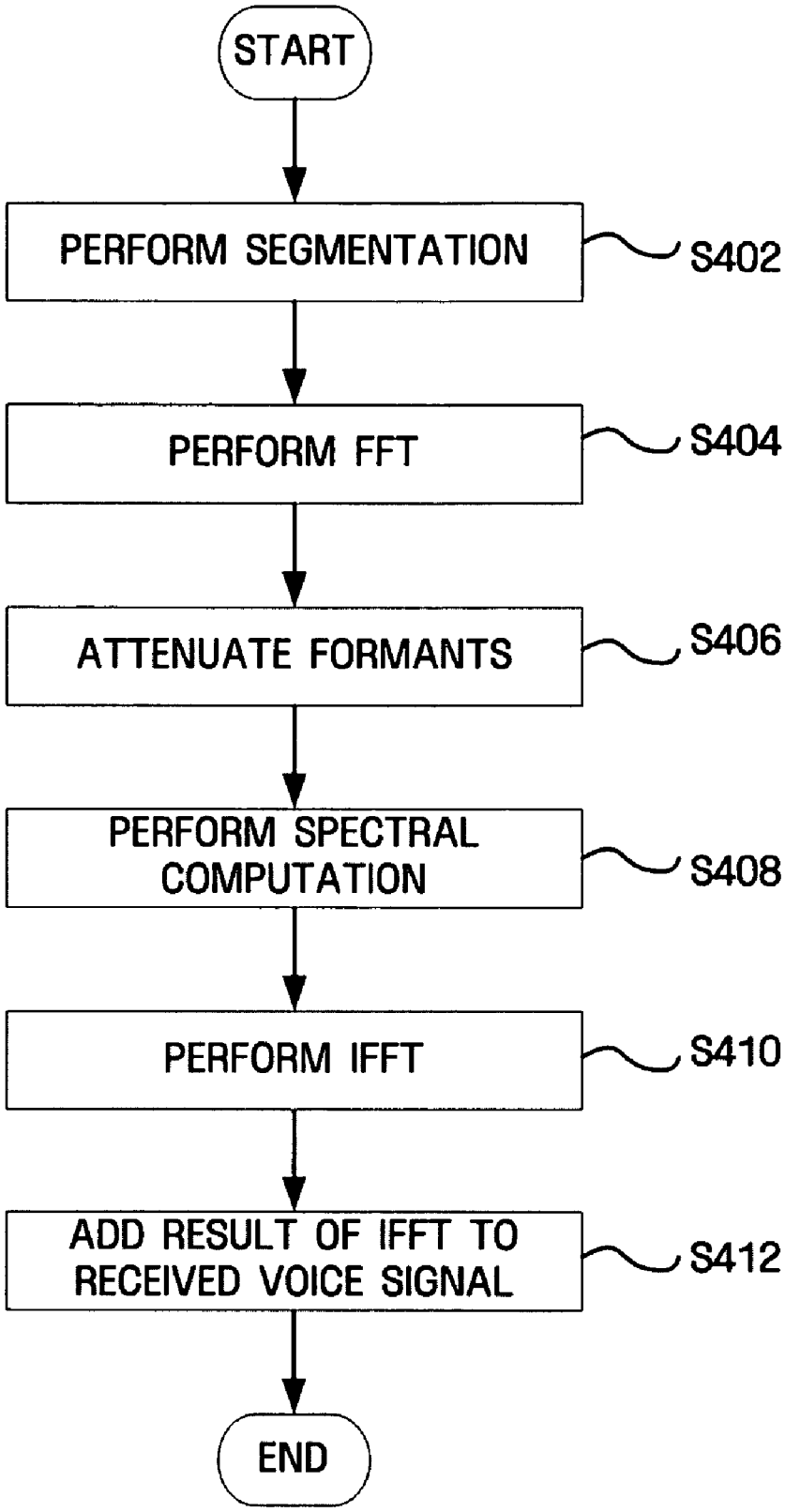
FIG. 7 is a flowchart illustrating a method of masking a received voice signal according to an embodiment of the present invention.

FIG. 7 is a flowchart illustrating a method of masking a received voice signal according to an embodiment of the present invention. Referring to FIG. 7, in operation S402, a received voice signal is appropriately segmented. For example, a frequency domain of the received voice signal may be segmented into a plurality of frames of the same size, as indicated by reference numeral 210 of FIG. 5. Operation S402 may be performed using a Hamming window. In operation S404, a Fast Fourier Transform (FFT) is performed on the results of the segmentation performed in operation S402.

In operation S406, formants are removed from the result of the FFT performed in operation S404. In operation S408, spectral computation is performed on the results of the removal performed in operation S406. The spectral computation may be performed by generating the signal 230 of FIG. 5 and transforming the phase of the signal 230 into that of the signal 240 of FIG. 5. In operation S410, an inverse FFT (IFFT) is performed on the result of the spectral computation performed in operation S408. In operation S412, the result of the IFFT is added to the received voice signal. In this manner, the masked voice signal 240 of FIG. 5 can be obtained. Accordingly, a third party cannot recognize formants in the received voice signal.

Alternatively, the voice signal may be masked using a time-domain method which involves performing an IFFT on the results of the removal performed in operation S406 and adding the result of the IFFT to the received voice signal.

Still alternatively, the voice signal may be masked by filling the spectral envelope of the voice signal with a set of harmonics or distorting the spectral lines of the voice signal so that format information can be removed from the voice signal.

According to the present invention, it is possible to prevent a received voice signal heard by a user from also being heard by a third party.

In addition, according to the present invention, it is possible to enhance the effect of sound attenuation and sound masking by masking the received voice signal heard by the user and appropriately processing a feedback signal of the received voice signal, which can be heard by the surrounding audience.

While the present invention has been particularly shown and described with reference to exemplary embodiments thereof, it will be understood by those of ordinary skill in the art that various changes in form and details may be made therein without departing from the spirit and scope of the present invention as defined by the following claims.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of disturbing a voice signal by attenuating and masking the voice signal, the method comprising:
- receiving a voice signal from a wired or wireless network by a mobile communication device;
- obtaining a masked voice signal for the received voice signal divided into a plurality of segments;
- outputting the received voice signal;
- receiving a feedback signal of the output voice signal;
- obtaining an attenuated voice signal by performing a first sound attenuation operation on the feedback signal; and
- combining the attenuated voice signal and the masked voice signal and outputting the result of the combination as disturbing sound.

2. The method of claim 1 further comprising, performing a second sound attenuation operation on the masked voice signal, and outputting the result of the second sound attenuation operation together with the received voice signal.

3. The method of claim 1, wherein the obtaining a masked voice signal comprises:
- generating a first signal which comprises a difference between the received voice signal and a spectral envelope of the received voice signal; and
- generating a second signal whose phase is opposite to the phase of the first signal,
- wherein the masked voice signal is the second signal.

4. The method of claim 1, wherein the obtaining a masked voice signal comprises:
- segmenting the received voice signal;
- performing FFT (Fast Fourier Transform) on the segmented received voice signal;
- removing formants from the result of FFT;

performing spectral computation on the results of removal formants;

performing IFFT (Inverse FFT) on the results of spectral computation; and adding the results of IFFT to the received voice signal.

5. An apparatus to disturb a voice signal by attenuating and masking the voice signal, the apparatus comprising:

a masking sound generation unit to receive a voice signal from a wired or wireless network, and obtains a masked voice signal for the received voice signal divided into a plurality of segments of the same size;

a sound output unit to output the received voice signal;

a sensing microphone to receive a feedback signal of the voice signal output by the sound output unit;

a first attenuation filter unit to attenuate the feedback signal received by the sensing microphone; and a disturbing sound output unit to combine the attenuated feedback signal and the masked voice signal and outputs the combined signal.

6. The apparatus of claim 5, further comprising a second attenuation filter unit to attenuate the masked voice signal, wherein the sound output unit to output the attenuated masked voice signal together with the received voice signal.

7. The apparatus of claim 5, wherein the masking sound generation unit to generate a first signal which comprises a difference between the received voice signal and a spectral envelope of the received voice signal and a second signal whose phase is opposite to the phase of the first signal and provides the first and second signals to the disturbing sound output unit.

8. The apparatus of claim 5, further comprises:

a filter/gain controller to adjust a gain of the voice signal sensed by the sensing microphone.

9. An apparatus to disturb a voice signal by attenuating and masking the voice signal, the apparatus comprising:

a masking sound generation unit to receive a voice signal from a wired or wireless network, and obtain a masked voice signal for the received voice signal divided into a plurality of segments;

a sound output unit to output the received voice signal;

a sensing microphone to receive a feedback signal of the voice signal output by the sound output unit;

a first attenuation filter unit to attenuate the feedback signal received by the sensing microphone; and a disturbing sound output unit to combine the attenuated feedback signal and the masked voice signal.

10. An apparatus to disturb a voice signal by attenuating and masking the voice signal, the apparatus comprising:

a masking sound generation unit to receive a voice signal from a wired or wireless network, and obtain a masked voice signal for the received voice signal divided into a plurality of segments of the same size;

a sound output unit to output the received voice signal;

a sensing microphone to receive a feedback signal of the voice signal output by the received sound output unit;

a filter/gain controller to filter and/or gain of the feedback signal received from the sensed microphone;

a first adaptive filter to generate disturbing sound based on a received voice signal and output of filter/gain controller and output the generated disturbing sound to a disturbing sound output unit;

a gain controller controls a gain of masked voice signal based on the filtered and/or gain controlled feedback signal and output a gain controlled masked voice signal;

a combiner to combine the gain controlled masked voice signal and attenuated voice signal and output the combined signal; and a disturbing sound output unit to output disturbing sound based on the combined signal which is input from received the combiner.

11. The apparatus of claim 10, further comprising a second adaptive filter unit to attenuate the masked voice signal, wherein the sound output unit to output the attenuated masked voice signal together with the received voice signal.

* * * * *

UNITED STATES PATENT AND TRADEMARK OFFICE

CERTIFICATE OF CORRECTION

PATENT NO. : 7,761,292 B2
APPLICATION NO. : 11/528316
DATED : July 20, 2010
INVENTOR(S) : Attila Ferencz et al.

It is certified that error appears in the above-identified patent and that said Letters Patent is hereby corrected as shown below:

Title page column 1 item 75 (Inventors), line 1, delete "Attiia" and insert -- Attila --, therefor.

Signed and Sealed this
Twenty-eighth Day of December, 2010

David J. Kappos

David J. Kappos
*Director of the United States Patent and Trademark Office*